US006938756B2

(12) United States Patent
Schuster

(10) Patent No.: US 6,938,756 B2
(45) Date of Patent: Sep. 6, 2005

(54) THREE PIECE BASKET CARRIER

(75) Inventor: Richard Schuster, Monroe, LA (US)

(73) Assignee: Graphic Packaging International, Inc., Marietta, GA (US)

( * ) Notice: Subject to any disclaimer, the term of this patent is extended or adjusted under 35 U.S.C. 154(b) by 13 days.

(21) Appl. No.: 10/246,604

(22) Filed: Sep. 18, 2002

(65) Prior Publication Data

US 2004/0050722 A1 Mar. 18, 2004

(51) Int. Cl.[7] ..... B65D 71/00
(52) U.S. Cl. ..... 206/179; 206/178
(58) Field of Search ..... 206/175–179, 206/198, 427; 229/120.24

(56) References Cited

U.S. PATENT DOCUMENTS 2,460,108 A * 1/1949 Smith et al. ..... 206/179
3,029,977 A * 4/1962 Arneson ..... 206/179
3,053,411 A * 9/1962 Struble et al. ..... 206/179
3,128,906 A * 4/1964 Forrer ..... 206/179
3,190,487 A * 6/1965 Wood ..... 206/179
3,191,800 A * 6/1965 Kowal ..... 206/179
3,236,414 A * 2/1966 Slevin, Jr. ..... 206/179
3,554,401 A * 1/1971 Wood ..... 206/178
3,624,790 A * 11/1971 Stout ..... 206/178
3,661,297 A * 5/1972 Wood ..... 206/187
5,947,273 A * 9/1999 Dalrymple et al. ..... 206/178
6,131,729 A * 10/2000 Eckermann et al. ..... 206/178

* cited by examiner

*Primary Examiner*—Jim Foster
(74) *Attorney, Agent, or Firm*—Womble Carlyle Sandridge & Rice, PLLC

(57) ABSTRACT

A glued three piece folding basket carrier which has two partitions for dividing the carrier into six cells with each partition being constructed of a different material than used to construct the outside basket carrier. Each partition is glued to a handle panel and a divider flap on the end of the basket carrier and a to a side wall to form a bottle cell with walls that are perpendicular to the divider between the two sides of the carrier and which are also formed as part of the partition.

6 Claims, 4 Drawing Sheets

THREE PIECE BASKET CARRIER

TECHNICAL FIELD

The present invention relates to basket carriers formed from three pieces of board and glued together on a straight-line gluer. The outside portion of the basket carrier, which may be called the box, can be made from a single blank, preferably of coated paperboard. The partitions which are needed to carry bottles can be made from a less expensive material, such as uncoated paperboard. Alignment slots or apertures may be provided in both partitions so that the partition can be properly aligned with the outside basket carrier in proper position for gluing.

BACKGROUND OF THE INVENTION

Basket carriers for bottles have been around for many years. These have normally had to be glued on right-angle gluers in order to ensure that all of the panels and flaps that were being glued were in proper position for alignment when glued. Gluing on a right-angle gluer facilitated the folding and gluing of these multi-piece carriers, but it was a relatively expensive process.

Basket carriers have typically been made from a single blank of material, usually coated paperboard so that product identity and any advertisement could be printed on the carrier. It is obvious that coated paperboard is not needed for producing the interior of the carton (i.e., partitions) as printing is not normally placed there. Consequently, it would be desirable to make these partitions out of a less expensive material, such as uncoated paperboard, or recycled board, which would significantly lower the cost of the carrier. In the past, there has been no good manufacturing method for producing three piece carrier on a straight-line gluer.

PRIOR ART

U.S. Pat. No. 5,947,273, issued Sep. 7, 1999 (Dalrymple, et al.) discloses a basket carrier in which the primary blank forms the outside of the carrier that is printed. The secondary blank is used to make the internal divider walls. The secondary blank is designed to be tipped into the primary blank on a straight-line gluer. Properly aligned partitions are not likely to be obtained with this carrier on the gluer as there is no method for aligning the two blanks together as the partition is basically tipped into the primary blank (col. 3, lines 45–49).

U.S. Pat. No. 6,131,729 (Eckermann, et al.) discloses a carrier where the outer portion of which is constructed from one material and the wall with cell dividers is constructed from another material, it is basically, a two piece carrier. No method is disclosed in this patent for accurately aligning the two pieces together.

SUMMARY OF THE INVENTION

It is an object of this invention to provide a basket carrier in which the outside walls, or the box, can be made out of material that can be printed upon, such as coated paperboard and the interior partitions can be made out of a cheaper material, such as uncoated paperboard or recycled board. It is a further object of this invention to produce this basket carrier on a straight-line gluer in order to achieve high production efficiencies.

The objects of this invention have been achieved in which the basket carrier's outside panels, or box, are constructed of a different material than the partitions. The outside of the basket carrier, or box, can be constructed out of a material that can be printed, such as coated paperboard. It is highly desirable to print the name of the product contained and advertising material on the outside portion of the basket carrier, or box. The partitions inside the box do not need to be printed and consequently can be constructed from a cheaper material and possibly of a lower caliber than the coated paperboard used to construct the outside portion, or box, of the carrier. As the partitions are constructed of a different material than the outside of the basket carrier, the partitions need to be cut from a different material, such as uncoated paperboard. The outside of the basket carrier is constructed of one material and formed into a single blank while the partitions are constructed from a different type of material and formed into two pieces, which basically provides a three-piece basket carrier. In order to properly align the partitions for gluing to the outside portion of the basket carrier, or box, on a straight-line gluer, it is necessary to provide the handle panels with alignment slots and to have corresponding alignment slots in the partitions. A pin locator on the gluer can align the alignment slots in the partition with those in the handle panel. Each partition has two ends, each of which is glued to a side panel. Each partition also has two divider extensions that are glued to each other and to a divider flap on an adjacent end of the basket carrier.

These and other objects, features, and advantages of the present invention will become more apparent upon reading the following specification in conjunction with the accompanying drawing figures.

BRIEF DESCRIPTION OF THE DRAWINGS

Many aspects of the invention can be better understood with reference to the following drawings. The components in the drawings are not necessarily to scale, emphasis instead being placed upon clearly illustrating the principles of the present invention. Moreover, in the drawings, like reference numerals designate corresponding parts throughout the several views.

DETAILED DESCRIPTION OF THE PREFERRED EMBODIMENT

Figure 1:
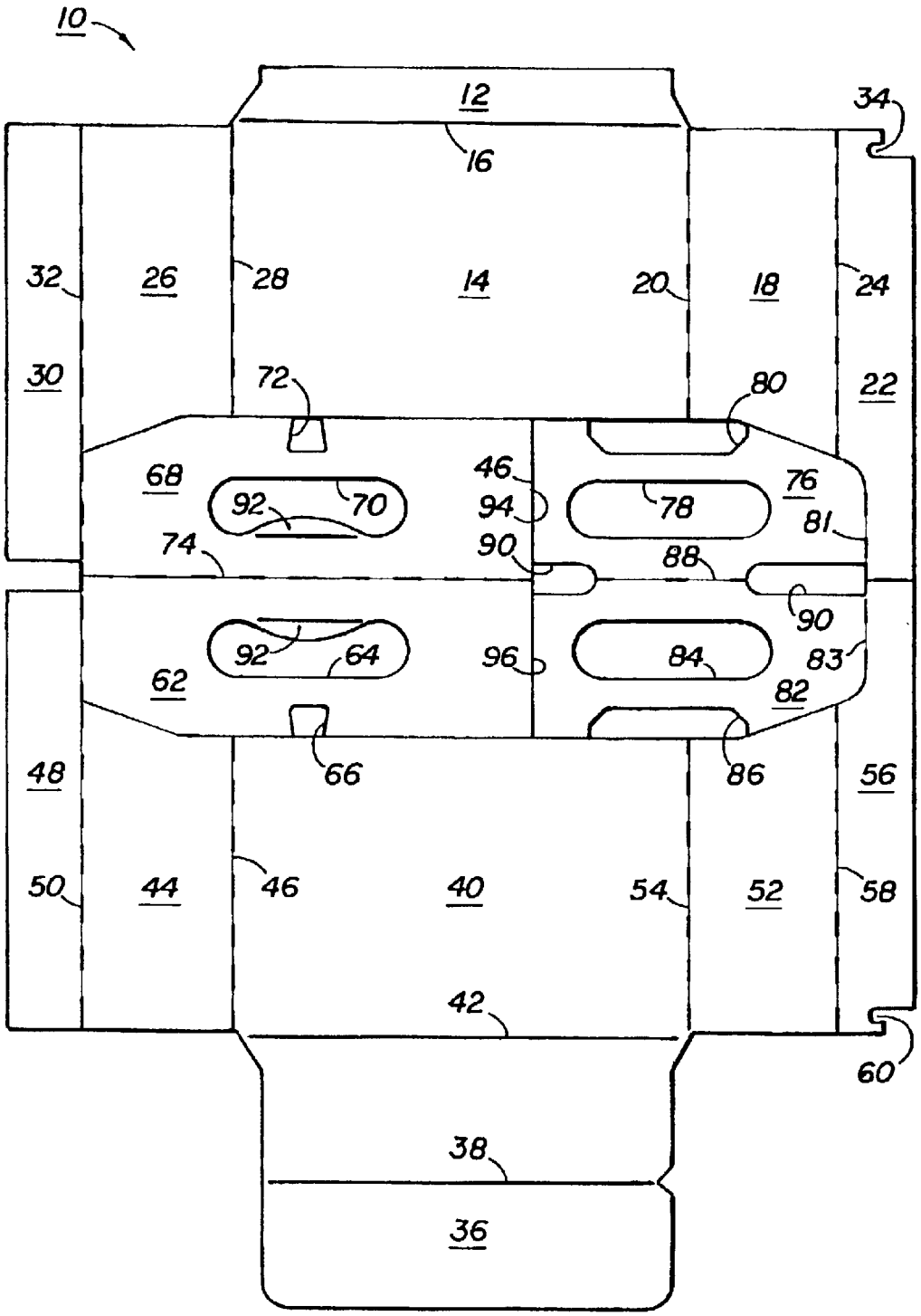
FIG. 1 is a plan view of a blank for forming the outside of the basket carrier of this invention.

The present invention is intended primarily as a basket carrier for carrying a plurality of bottles, in particular glass bottles. The outside of the basket carrier can be formed from a single piece of foldable material, such a blank cut out of coated paperboard. The blank for the outside of the carrier is basically rectangular to economize the amount of coated paperboard used. The carrier is a three piece carrier having two partitions that can be made from a different type of material, such as uncoated paperboard or recycled board. These partition panels can be cut from a sheet of such material.

In one embodiment of this invention, the carrier is characterized by having alignment slots in the partitions and in the handle panels for aligning the partitions inside the outside portion of the basket, or box, for gluing. A second embodiment of this invention has two alignment apertures in each partition for aligning the partitions in proper position prior to gluing.

The outside portion of the basket, or box, is shown in the blank 10 which has a glue flap on the bottom 12 which is attached to side panel 14 by fold line 16. Side panel 14 in turn is attached to end panel 18 by fold line 20, and said end panel 18 is attached to the divider flap 22 by fold line 24. Side panel 14 is attached to end panel 26 by fold line 28 which in turn is attached to divider flap 30 by fold line 32. Divider flap 22 may have a bottom holding hook 34 which will be discussed infra. Turning to the other side of the carrier, there is a bottom panel 36, which may have a fold line 38. The bottom panel 36 in turn is attached to side panel 40 by fold line 42 and side panel 40 in turn is attached to end panel 44 is by fold line 46. End panel 44 is attached to divider flap 48 by fold line 50. In this similar fashion, end panel 52 is attached to side panel 40 by fold line 54 and end panel 52 is attached to divider flap 56 by fold line 58. Divider flap 56 has a bottom holding hook 60.

This carrier has a 4-ply handle with outside handle panel 62 which has a handle 64 and an alignment slot 66. There is a corresponding outside panel 68 which has a handle 70 and an alignment slot 72. Outside handle panels 62, 68 are connected by fold line 74. Handle panel 62 is attached to divider flap 48 by fold line 50. Similarly, outside handle panel 68 is attached to divider flap 30 by fold line 32. Inside handle panel 76 has a handle 78 and a partition cut-out 80. On the other side of the carrier, is located inside handle panel 82 which has a handle 84 and a partition cut-out 86. Inside handle panels 76, 82 are attached together by fold line 88. Inside handle panel 76, 82 may have a cut-out 90. Handles 64, 70 may have cushioning flaps 92 to ease the strain on the hand of the person carrying the carrier. Inside handle panel 76, 82 are folded inside of outside handle panels 62, 68 to produce a four-ply handle structure. Outside handle panels 62, 68 have edges 94 and inside handle panels 76, 82 have edges 96. Inside handle panels 76, 82 are attached to divider flaps 22, 56 by fold lines 81, 83 respectively.

The outside basket carrier, or box, described above is preferably constructed out of coated paperboard to allow printing.

Figure 2A:
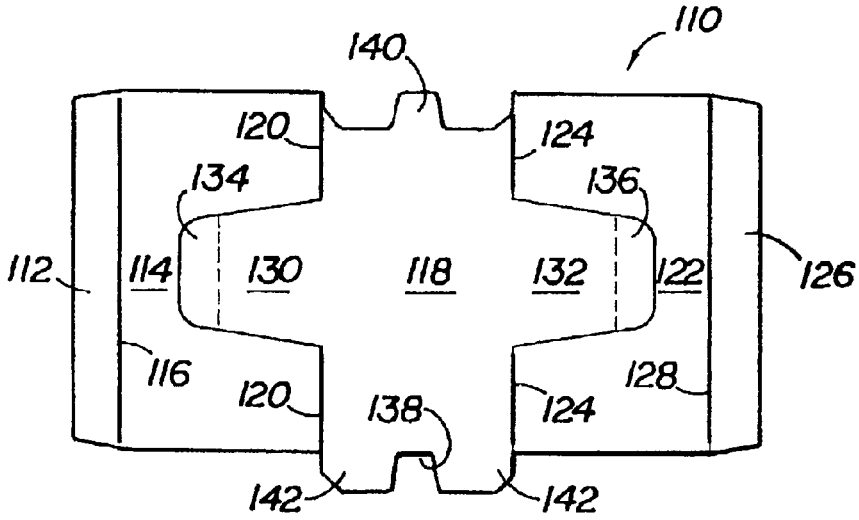
FIG. 2A is a plan view of one style of blank for the partition for the basket carrier of this invention.
Figure 2B:
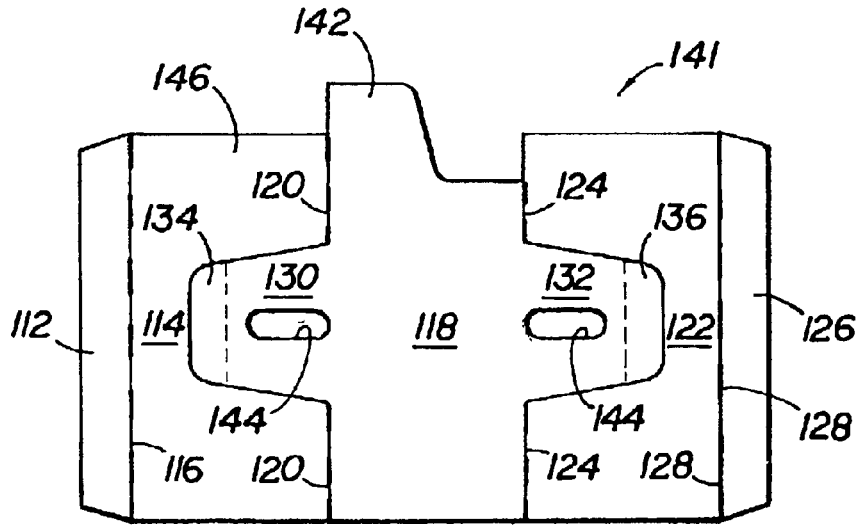
FIG. 2B is a plan view of another style of blank for the partition for the basket carrier of this invention.

Two different types of blanks for partitions are disclosed below in FIGS. 2A and 2B. The blanks for the partitions shown in FIG. 2A are identical to each other while the blanks for the partitions shown in FIG. 2B are identical to each other. The partition shown in FIG. 2A will be discussed first. The partitions are cut from a single sheet of board in a nested fashion. The blank for the partition 110 illustrated in FIG. 2A has a glue flap 112 attached to partition panel 114 by fold line 116 which is attached to divider panel 118 by fold line 120 and in turn attached to partition panel 122 by fold line 124. Partition panel 122 is attached to glue flap 126 by fold line 128. Divider panel 118 has a divider panel extensions 130 and 132 and glue flaps 134 and 136. Divider panel 118 may have an alignment slot 138 for aligning the partition panel blanks 110 with the outside basket carrier 10. Divider panel 118 may have a bottom support 140.

Figure 3:
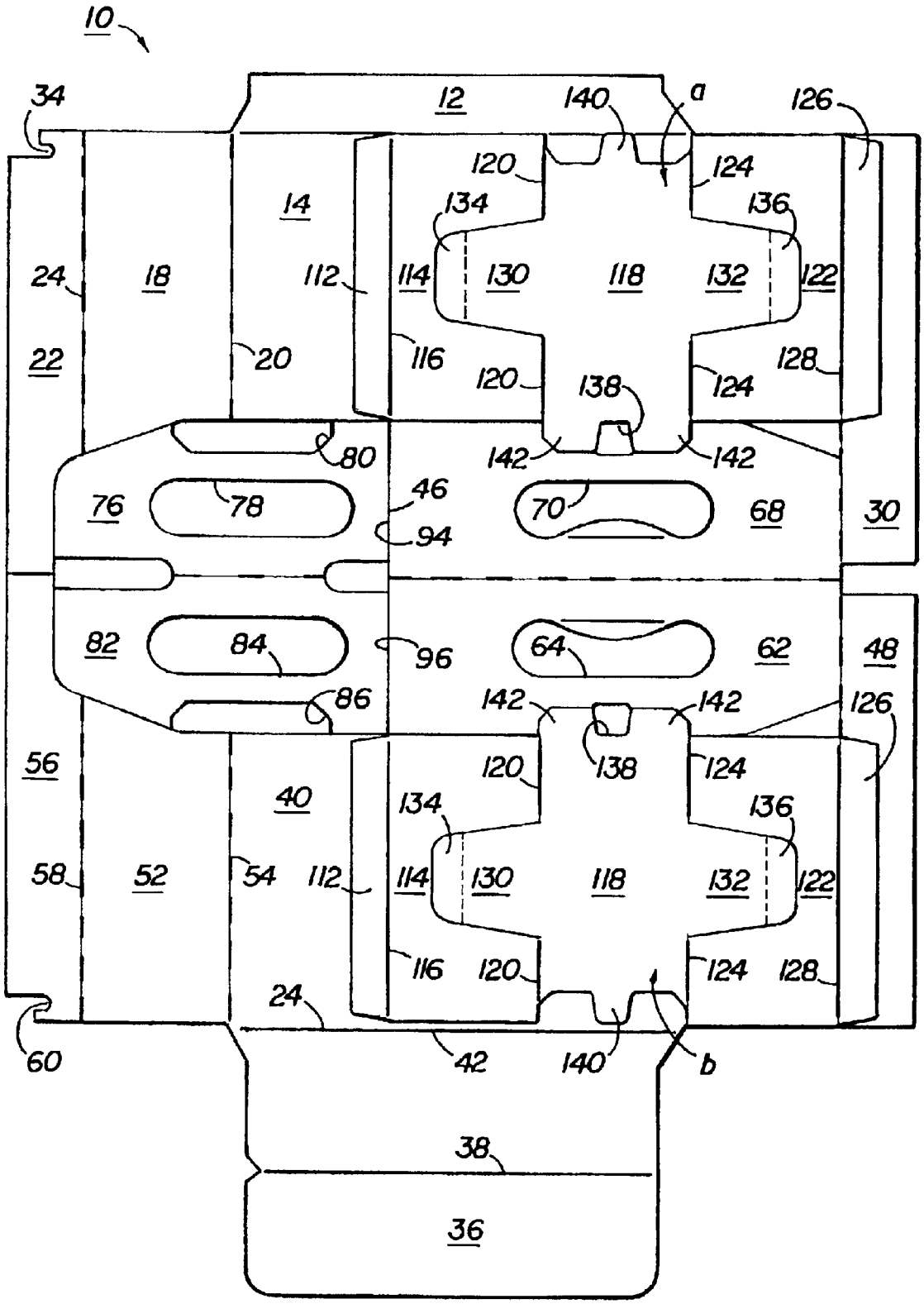
FIG. 3 is a plan view of the blank of FIG. 1 with the partitions of FIG. 2A glued in proper position.
Figure 4:
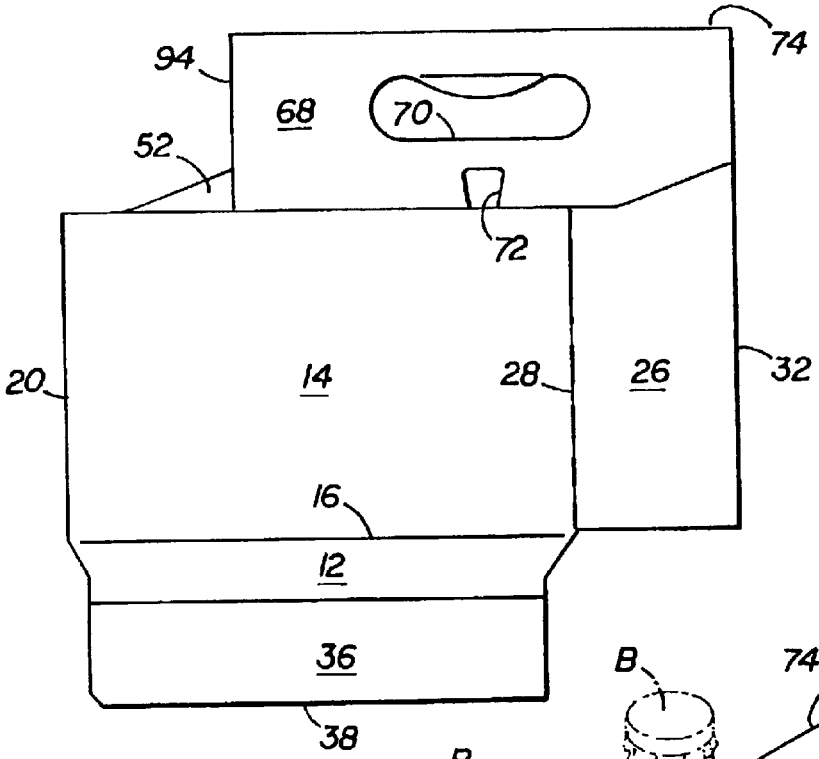
FIG. 4 is a plan view of the blank of FIG. 1 with the partitions glued in place that has been folded along the center line with the partitions glued together and the bottom of the carton glued.
Figure 5:
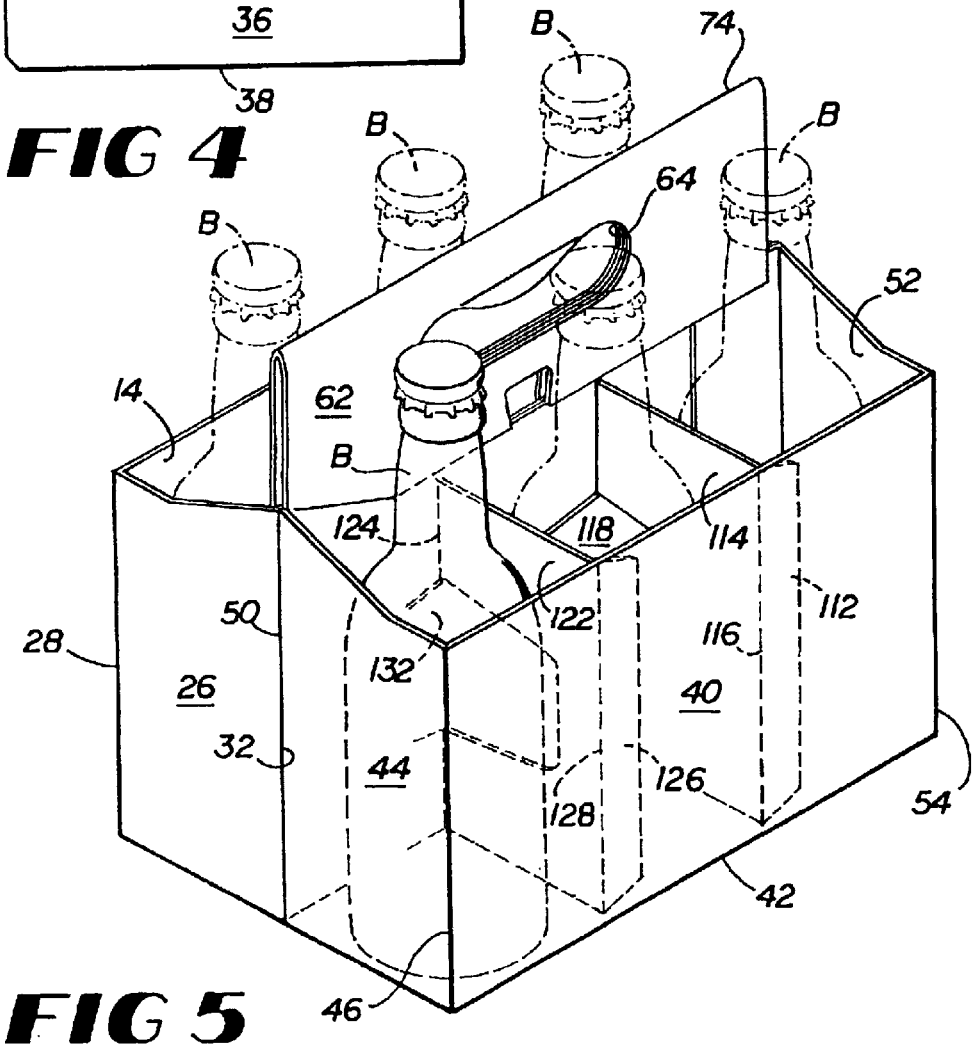
FIG. 5 is a perspective view of the basket carrier made from the blank of FIG. 1 and filled with bottles.

As shown in FIG. 2A, both partitions are identical. One is labeled a and the other b as illustrated in FIG. 3. This basket carrier can be produced on a straight-line gluer that has an inserter to insert the two partitions a and b into the carrier. The inserter basically places apertures 138 and 72 in alignment.

If desired, the partitions can be cut by a die cutter, such as a rotary die cutter prior to entering the inserter. The basket carrier blank 10 can be held on the gluer by a vacuum. It is very important that partitions a and b are located precisely with the basket carrier blank 10 so that the cells for the bottles are of the proper size and configuration. This can be accomplished by the use of locator pins that line up the alignment slots 138 on the blank for partition 110 with the alignment slots 66 and 72 on the blank 10 for the basket carrier. Guides on the gluer may assist in obtaining the proper alignment of the partition blank 110 with the blank for the basket carrier 10.

Alternatively, apertures 144 may be placed in the divider panel extensions 130 and 132 to facilitate locating the blank for the partition 141 in the proper location within the basket carrier as shown in FIG. 2B. Locator pins can be inserted in these apertures 144 to locate partitions in the proper location for gluing. Partition 141 does not need alignment slots 138, 66 and 72.

In respect to partitions 110, glue flaps 112 from partitions a and b are glued to the appropriate side panel 14, 40. Glue flaps 126 on partitions a and b are folded over and likewise glued to the appropriate side panels 14, 40, thus producing three bottle cells on each side of the basket carrier. Glue flaps 142 on partitions a and b are glued on the reverse side to outside handle panels 62, 68 so that alignment slots 66, 72 are in alignment with alignment slot 138 on the appropriate partition a or b. End panels 18, 52 along with the attached divider flaps 22, 56 are folded along fold lines 20, 54 with inside handle panels 76, 82 brought into proper position in alignment with outside handle panels 62, 68 will thus be seen. Partition cutouts 80, 86 are designed not to interfere with the location of the locator pin with the appropriate alignment slots 66, 72 in blank 10 with alignment slots 138 on partitions a and b. Glue tabs 134 on partitions a and b are glued to the adjacent divider flap 22 or 56. In a similar fashion, glue tabs 136 on partitions a and b are glued to the inside surface of adjacent divider flap 30, 48. The blank for the basket carrier 10 with partitions a and b glued in place is then folded along fold line 74 with glue flap 12 glued to bottom panel 36 which concludes the production of the folded basket carrier.

Partition blanks 141 shown in 2B are placed in the basket blank 10 in a similar fashion except that locator pins are used to locate the blank through apertures 144.

The basket carrier is then ready for delivery to a bottling plant where the basket carrier is erected and filled with bottles. Bottom holding hooks 34, 60 are engaged with bottom panel 36 to hold it in proper position and prevent it from sagging with the weight of the bottles. Bottom support 140 on partitions a and b also help to keep the bottom panel in proper position along with bottom portion of the partition panels 114 on partitions a and b.

UNIQUE FEATURES OF THIS INVENTION

The three piece basket carrier is unique in that the outside basket carrier, or box, is made of one material and the two partition inserts may be made of a different and less expensive material. Preferably, the outside basket carrier, or box, is made of coated paperboard, while the inside partition can be made of uncoated board or recycled board. This basket carrier is also unique in that it has means for precisely locating the partition within the outside basket carrier, or box. This can be done by the provision of alignment slots or alignment apertures. The alignment slots are between the partition and the handle panel, while alignment apertures may be placed in the body of the partition, so that a locator pin and other guides can keep the partition in proper position for gluing. If the locator apertures are placed in the divider panel extension 130, 132, it must be placed in both locations in order to hold the partition in proper location for gluing as shown in FIG. 2B.

It should be realized that the use of a cheaper material for the partitions results in substantial savings as the partitions constitute 25–40% of the total square inches of material used to make the basket carrier with the partition panels.

While this invention has been disclosed in its preferred forms, it will be apparent to those skilled in the art that many modifications, additions, and deletions can be made therein without departing from the spirit and scope of the invention and its equivalents as set forth in the following claims.

I claim:

1. A glued three piece folding basket carrier for carrying six bottles comprising:

a. a basket structure with a bottom panel with side panels and end panels with a divider flap foldably attached to each end panel, and a four-ply handle, all constructed from a single piece of paperboard; and b. said carrier basket having two partitions for dividing the carrier into six cells for carrying bottles, each partition being a separate piece cut from a different material than is used to construct the basket structure (a), each partition having two ends with a partition panel on each end which is glued to an adjacent side panel, with a divider panel located between the partition panels and which is glued to an adjacent side panel, with a divider panel located between the partition panels and which is glued to an adjacent handle ply, the divider panel having two divider panel extensions cut from the partition panels, each of which is glued to an adjacent divider flap, said partition panels being perpendicular to the divider panel and forming three cells for carrying bottles, wherein each partition has two alignment apertures in each partition for correctly aligning the partitions in the basket structure, including a one of said apertures being located in each divider panel extension.

2. A glued three piece folding basket carrier for carrying six bottles comprising:

a. a basket structure with a bottom panel with side panels and end panels with a divider flap foldably attached to each end panel, and a four-ply handle, all constructed from a single piece of paperboard; and b. said carrier basket having two partitions for dividing the carrier into six cells for carrying bottles, each partition being a separate piece cut from a different material than is used to construct the basket structure (a), each partition having two ends with a partition panel on each end which is glued to an adjacent side panel, with a divider panel located between the partition panels and which is glued to an adjacent handle ply, the divider panel having two divider panel extensions cut from the partition panels, each of which is glued to an adjacent divider flap, said partition panels being perpendicular to the divider panel and forming three cells for carrying bottles, wherein each divider panel has an alignment slot and the handle ply to which the divider panel is glued has a corresponding alignment slot, said slots being aligned together when the carrier is glued to properly position the partition panels (b) in the basket structure (a).

3. The basket carrier of claim 2 in which each handle ply that is not glued to a divider panel has a cut out to prevent said handle ply from interfering with the alignment of the alignment slots in the divider panel and handle ply to which it is glued.

4. A glued three piece folding basket carrier for carrying six bottles comprising:

(a) a basket structure with a bottom panel with side panels and end panels with a divider flap foldable attached to each end panel, and a four ply handle, all constructed from one piece of material; and (b) said carrier having two partition for dividing the carrier into six cells for carrying bottles, each partition being a separate piece cut from a different material than is used to construct the basket structure (a), each partition having two ends and a divider panel in its center which is glued to an adjacent handle, and two divider panel extensions, each of which is glued to an adjacent divider flap with each partition having a partition panel on each end of the partition which is perpendicular to the divider panel of that partition, each partition panel having an end which is glued to an adjacent side panel, each partition forming three cells for carrying bottles, wherein each partition has two alignment apertures in each partion for correctly aligning the partitions in the basket structure (a), including a one of said apertures being located in each divider panel extension.

5. A glued three piece folding basket carrier for carrying six bottles comprising:

a. a basket structure with a bottom panel with side panels and end panels with a divider flap foldably attached to each end panel, and a four-ply handle, all constructed from a single piece of paperboard; and b. said carrier basket having two partitions for dividing the carrier into six cells for carrying bottles, each partition being a separate piece cut from a different material than is used to construct the basket structure (a), each partition having two ends with partition panel on each end which is glued to an adjacent side panel, with a divider panel having two divider panel extensions cut from the partition panels, each of which is glued to an adjacent divider flap, said partition panels being perpendicular to the divider panel and forming three cells for carrying bottles, wherein each divider panel has an alignment slot and the handle ply to which the divider panel is glued has a corresponding alignment slot said slots being aligned together when the carrier is glued to properly position the partitions (b) in the basket structure (a).

6. The basket carrier of claim 5 in which each handle ply that is not glued to a divider panel has a cut to prevent said handle ply from interfering with the alignment of the alignment slots in the divider panel and handle ply to which it is glued.

* * * * *

UNITED STATES PATENT AND TRADEMARK OFFICE

CERTIFICATE OF CORRECTION

PATENT NO. : 6,938,756 B2
APPLICATION NO. : 10/246604
DATED : September 6, 2005
INVENTOR(S) : Richard Schuster It is certified that error appears in the above-identified patent and that said Letters Patent is hereby corrected as shown below:

In the claims:
Column 6, claim 4, line 30, "partion" should be changed to --partition--

In the drawings:
Sheet 1, FIG. 1, delete the numeral "46" that is located in outside handle panel 68 and points to the edge that is labeled with numeral 94
Sheet 2, FIG. 2B, delete numeral "146" that is adjacent numeral 142
Sheet 3, FIG. 3, delete the numeral "46" that is located in outside handle panel 68 and points to the edge that is labeled with numeral 94.
Sheet 3, FIG. 3, delete the numeral "24" that is located in side panel 40 and points to the same fold line that is labeled with numeral 42.

In the summary of the invention:
Column 2, line 7, "caliber" should be changed to --caliper--

In the detailed description of the preferred embodiment:
Column 3, lines 57-58, cancel the sentence beginning with "Divider panel 118" and insert the following sentence: --Divider panel 118 has divider panel extensions 130 and 132 and glue flaps or tabs 134 and 136.--
Column 4, lines 47-49, add designation --B-- so that the sentence reads "The basket carrier is then ready for delivery to a bottling plant where the basket carrier is erected and filled with bottles B."

Signed and Sealed this

Fifteenth Day of January, 2008

JON W. DUDAS
*Director of the United States Patent and Trademark Office*